US007734226B2

(12) United States Patent
Greywall et al.

(10) Patent No.: US 7,734,226 B2
(45) Date of Patent: Jun. 8, 2010

(54) LIFT MECHANISM FOR ONE OR MORE DEVELOPER MEMBERS IN AN IMAGE FORMING DEVICE

(75) Inventors: Shaun S. Greywall, Lexington, KY (US); Brian Boettcher, Versailles, KY (US); Kevin Agnissey, Lexington, KY (US); Paul Douglas Horrall, Lexington, KY (US); Robert Galon Newman, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 133 days.

(21) Appl. No.: 11/948,286

(22) Filed: Nov. 30, 2007

(65) Prior Publication Data

US 2009/0142096 A1 Jun. 4, 2009

(51) Int. Cl.
*G03G 15/00* (2006.01)
*G03G 15/08* (2006.01)

(52) U.S. Cl. ..... 399/228; 399/113

(58) Field of Classification Search ..... 399/119, 399/113, 110, 107, 228

See application file for complete search history.

(56) References Cited

U.S. PATENT DOCUMENTS

| | | | | |
|---|---|---|---|---|
| 4,851,873 | A * | 7/1989 | Sakao et al. | 399/119 |
| 5,089,849 | A * | 2/1992 | Hiraoka | 399/119 |
| 7,509,071 | B2 * | 3/2009 | Yoshimura et al. | 399/110 X |
| 2007/0217816 | A1 * | 9/2007 | Shiraki | 399/113 X |

* cited by examiner

*Primary Examiner*—Sophia S Chen

(57) ABSTRACT

The present application is directed to devices and methods to position a developer member relative to a photoconductive member in an image forming device. One embodiment includes an elongated lift plate positioned in proximity to a photoconductive member. An elongated opening may be positioned within the lift plate. The opening may include a first section and a second section. The first section may be positioned farther from the photoconductive member than the second section. A positioning member may be positioned within the opening, and be operatively connected to the developer member. A hold down may bias the positioning member towards an edge of the opening. The lift plate may be longitudinally movable between a first position with the positioning member in the first section of the opening that positions the developer member away from the photoconductive member, and a second position with the positioning member in the second section that positions the developer member against the photoconductive member.

19 Claims, 6 Drawing Sheets

LIFT MECHANISM FOR ONE OR MORE DEVELOPER MEMBERS IN AN IMAGE FORMING DEVICE

BACKGROUND

The present application is directed to a lift mechanism and, particularly, to a mechanism that separates a developer member from a photoconductive member.

Image forming devices, such as but not limited to printers, facsimile machines, copiers, may include a development section for forming a toner image. The development section includes a developer member that receives toner and transfers it to a photoconductive member. In many devices, the developer member is placed in contact with the photoconductive member to facilitate transfer of the toner.

During certain events, such as shipping and storage, it may be necessary for the developer member to be separated from the photoconductive member. Contact between the members during these events may result in formation of a permanent set on the developer member. The permanent set usually takes the form of a flattened shape along the length of the developer member in the region that is in contact with the photoconductive member. The severity of the set may vary due to the force exerted between the members, the developer member material, environmental conditions, and elapsed time in a static position without separation. If the developer member were to obtain a permanent set, the flat spot would cause an unacceptable level of print quality.

Current systems employ a variety of methods to separate the developer member from the photoconductive member. One system includes foam sheets that are packed between the members. Another system includes individual lift mechanisms for each developer member-photoconductor member pair.

SUMMARY

The present application is directed to devices and methods to position a developer member relative to a photoconductive member in an image forming device. One embodiment includes an elongated lift plate positioned in proximity to a photoconductive member. An elongated opening may be positioned within the lift plate. The opening may include a first section and a second section. The first section may be positioned farther from the photoconductive member than the second section. A positioning member may be positioned within the opening, and the positioning member may be operatively connected to the developer member. A hold down may bias the positioning member towards an edge of the opening. The lift plate may be longitudinally movable between a first position with the positioning member in the first section of the opening that positions the developer member away from the photoconductive member, and a second position with the positioning member in the second section that positions the developer member against the photoconductive member.

DETAILED DESCRIPTION

Figure 1:
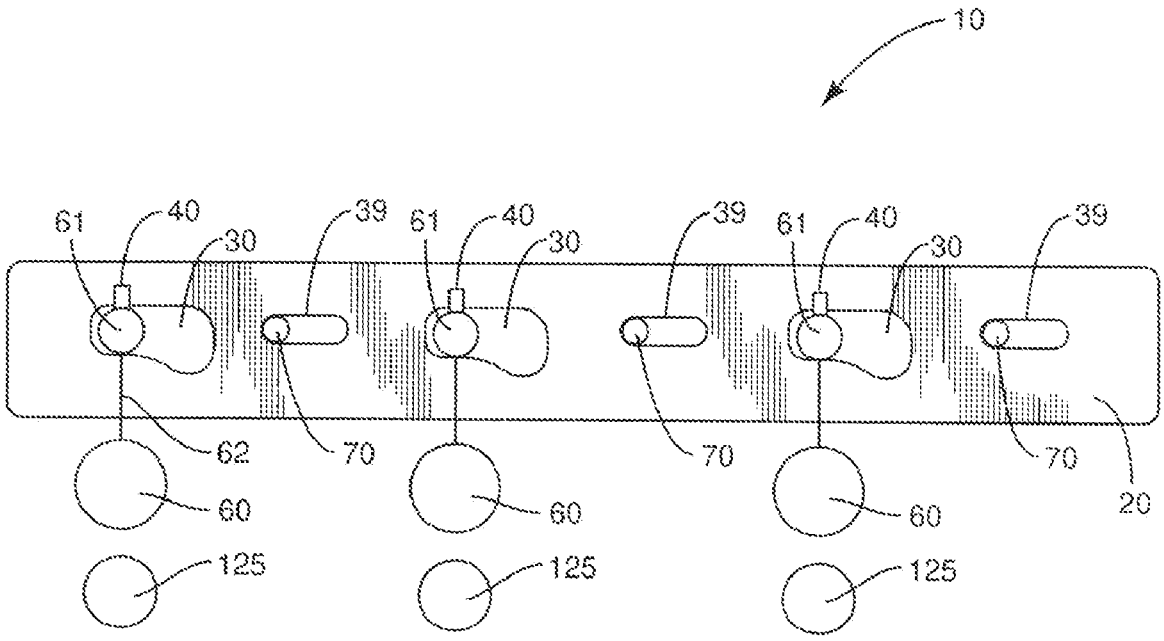
FIG. 1 is a schematic view of a lift device in a first position according to one embodiment.

The present application is directed to a lift device to position a developer member relative to a photoconductive member within an image forming device. FIG. 1 illustrates one embodiment of the lift device 10 that includes a lift plate 20 with at least one opening 30. Developer members 60 are operatively connected to the lift device 10 through positioning members 61 that are positioned within the openings, and bodies 62 that extend between the positioning members 61 and the developer members 60. Lateral movement of the lift plate 20 causes the positioning members 61 to vertically move within the openings 30 resulting in movement of the developer members 60 towards and away from the photoconductive members 125. FIG. 1 illustrates the lift device 10 in a first position with the developer members 60 spaced away from the photoconductive members 125. This position may be used for shipping and storage to prevent a set from occurring within the surface of the developer members 60.

Figure 2:
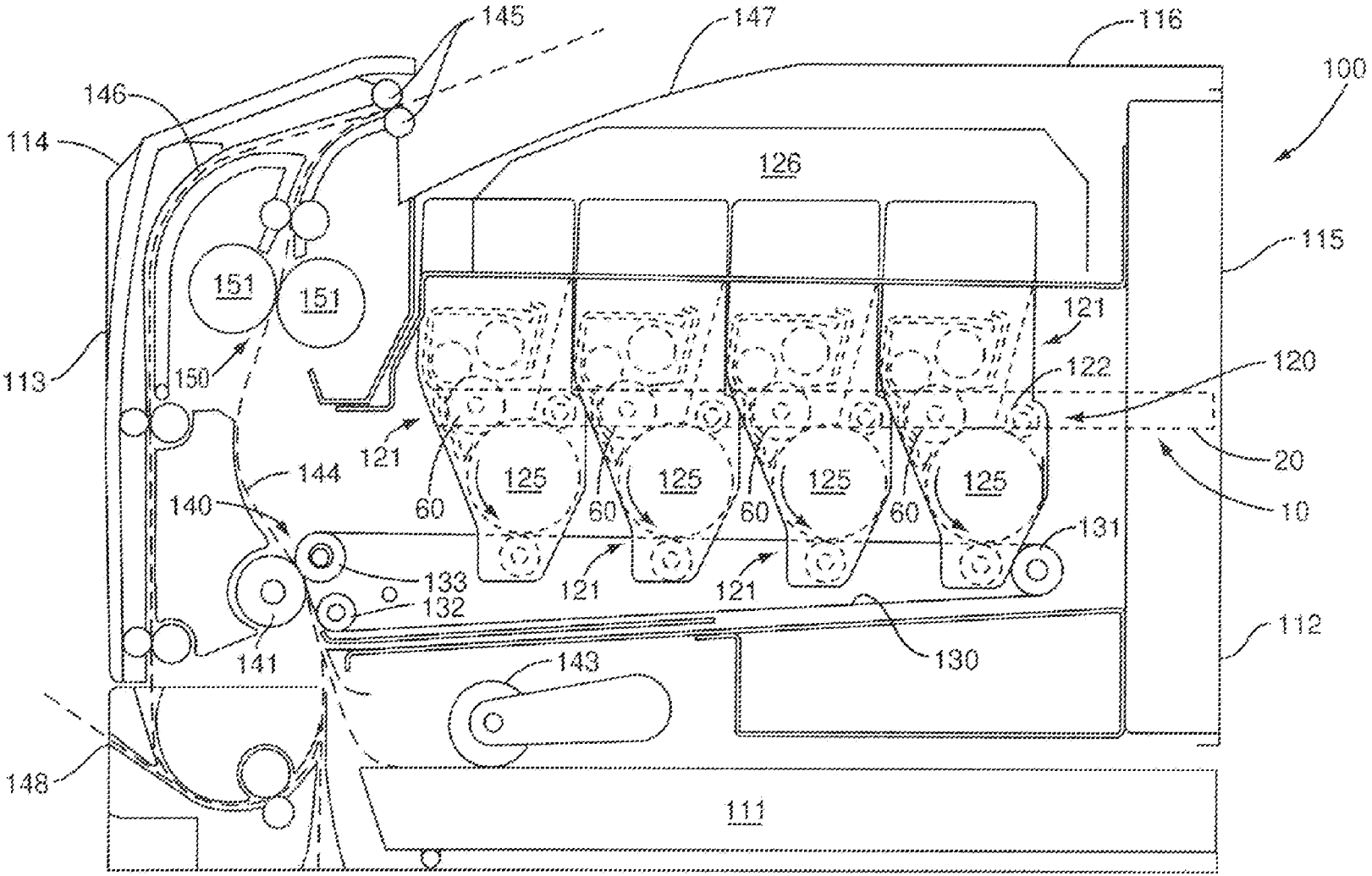
FIG. 2 is a schematic view of a lift device within an image forming device according to one embodiment.

To better understand the functioning of the lift device 10, an overview of an image forming device 100 and an image formation process is beneficial. FIG. 2 illustrates one embodiment of an image forming device 100. The device 100 includes a media input tray 111 positioned in a lower section of a body 112. The tray 111 is sized to contain a stack of media sheets that will receive color and/or monochrome images. The media input tray 111 is preferably removable for refilling. A control panel 114 may be located on the front 113 of the body 112. Using the control panel 114, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A first toner transfer area 120 includes one or more imaging units 121 that are aligned horizontally extending from the front 113 to a back 115 of the body 112. Each imaging unit 121 includes a charging roll 122, one of the developer members 60, and one of the PC members 125. The charging roll 122 forms a nip with the PC member 125, and charges the surface of the PC member 125 to a specified voltage such as −1000 volts, for example. A laser beam from a printhead 126 contacts the surface of the PC member 125 and discharges those areas it contacts to form a latent image. In one embodiment, areas on the PC member 125 illuminated by the laser beam are discharged to approximately −300 volts. The developer member 60, which also forms a nip with the PC member 125, then transfers toner particles to the PC member 125, to form a toner image. The toner particles are attracted to the areas of the PC member 125 surface discharged by the laser beam from the printhead 126.

An intermediate transfer mechanism (ITM) 130 is disposed adjacent to each of the imaging units 121. In this embodiment, the ITM 130 is formed as an endless belt trained about support roller 131, tension roller 132 and back-up roller 133. During image forming operations, the ITM 130 moves past the imaging units 121 in a clockwise direction as viewed in FIG. 2. One or more of the PC members 125 apply toner images in their respective colors to the ITM 130. In one embodiment, a positive voltage field attracts the toner image from the PC members 125 to the surface of the moving ITM 130.

The ITM 130 rotates and collects the one or more toner images from the imaging units 121 and then conveys the toner images to a media sheet at a second transfer area. The second transfer area includes a second transfer nip 140 formed between the back-up roller 133 and a second transfer roller 141.

A media path 144 extends through the device 100 for moving the media sheets through the imaging process. Media sheets are initially stored in the input tray 111 or introduced into the body 112 through a manual feed 148. The sheets in the input tray 111 are picked by a pick mechanism 143 and moved into the media path 144. In this embodiment, the pick mechanism 143 includes a roller positioned at the end of a pivoting arm. The roller rotates to move the media sheets from input tray 111 towards the second transfer area. In one embodiment, the pick mechanism 143 is positioned in proximity (i.e., less than a length of a media sheet) to the second transfer area with the pick mechanism 143 moving the media sheets directly from the input tray 111 into the second transfer nip 140. For sheets entering through the manual feed 148, one or more rollers are positioned to move the sheet into the second transfer nip 140.

The media sheet receives the toner image from the ITM 130 as it moves through the second transfer nip 140. The media sheets with toner images are then moved along the media path 144 and into a fuser area 150. Fuser area 150 includes fusing rollers or belts 151 that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

The lifting device 10 is positioned within the body 112 to engage with the developer members 60. In one embodiment, a single lift plate 20 is attached to the developer members 60. In another embodiment, lift plates 20 are operatively connected to each of the two lateral ends of the developer members 60. As illustrated in FIG. 2, the lift plates 20 extend outward from the back 115 of the body 112. A user may manipulate the lift plates 20 to position the developer members 60 as necessary. In other embodiments, the lift plates 20 may extend to the front 113, top 116, bottom, or lateral sides of the body 112. In another embodiment, the lift plates 20 are positioned within an interior of the body 112.

Figure 3:
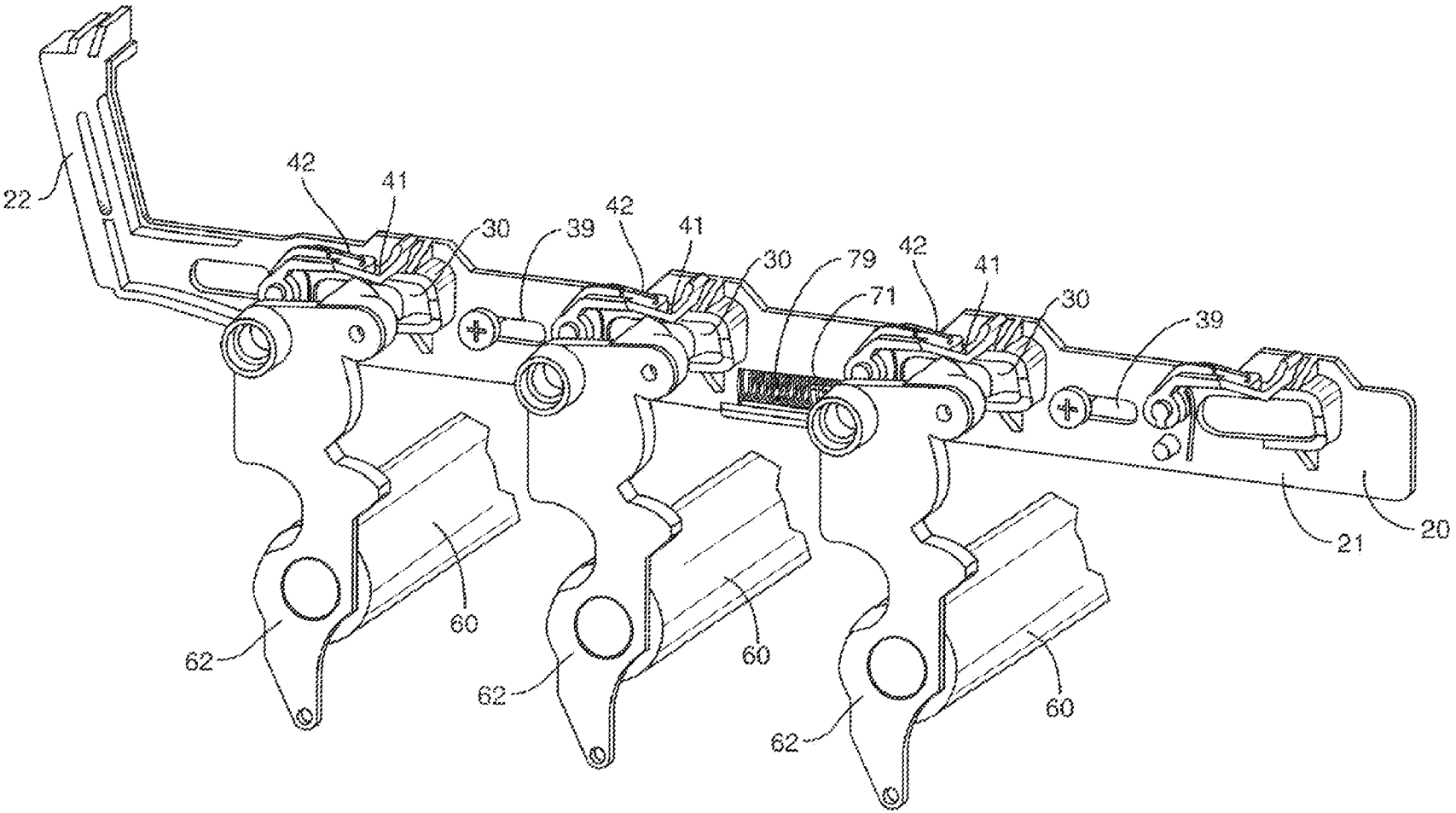
FIG. 3 is a perspective view of a lift device according to one embodiment.
Figure 4:
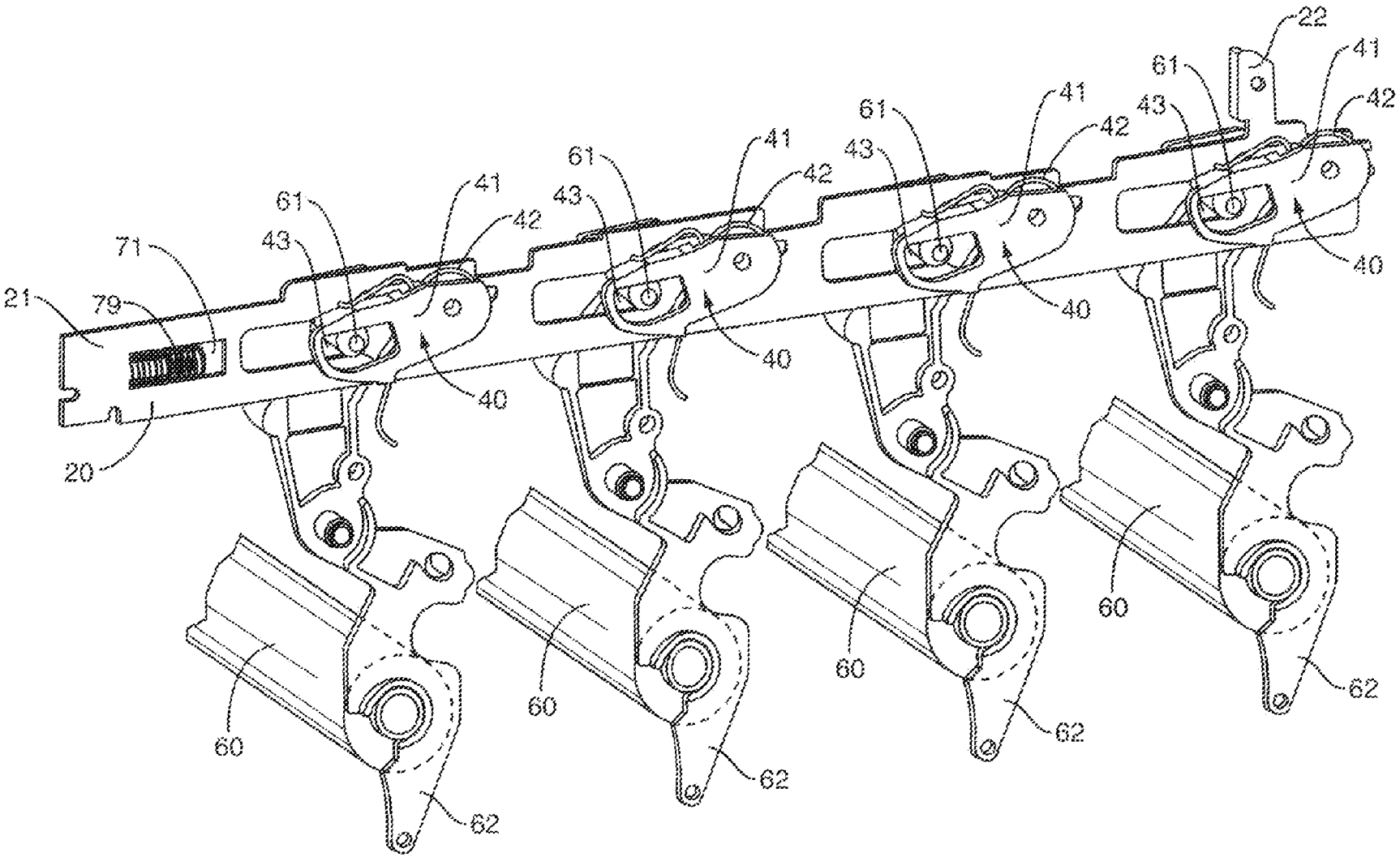
FIG. 4 is a perspective view of a lift device according to one embodiment.

FIG. 3 illustrates one embodiment of a lift plate 20 that includes a first section 21 and a second section 22. The first section 21 includes an elongated shape with a length to extend within the body 112 and be operatively connected with the developer members 60. The second section 22 is positioned at an angle from the first section 21. The second section 22 may be positioned on the exterior of the body 112 for manipulating by the user for setting the position of the developer members 60. FIG. 4 illustrates another embodiment of the lift plate 20 that includes a first section 21 and a second section 22. The lift plates 20 may be constructed from a variety of materials, including plastic, and sheet metal.

In embodiments with lift plates 20 at each lateral side of the developer members 60, each of the lift plates 20 may be substantially the same. In other embodiment, the lift plates 20 may be different. By way of example, a first lift plate 20 as illustrated in FIG. 3 may be positioned on a first lateral side, and a second lift plate 20 as illustrated in FIG. 4 may be positioned on a second lateral side.

Openings 30 are positioned along the length of the lift plates 20 to engage with the positioning members 61. The number of openings 30 along the lift plate 20 may vary, but normally corresponds to the number of developer members 60 within the image forming device 100. By way of example, the lift plate 20 used for the image forming device 100 of FIG. 2 includes four openings 30 to engage each of the four developer members 60.

Figure 5:
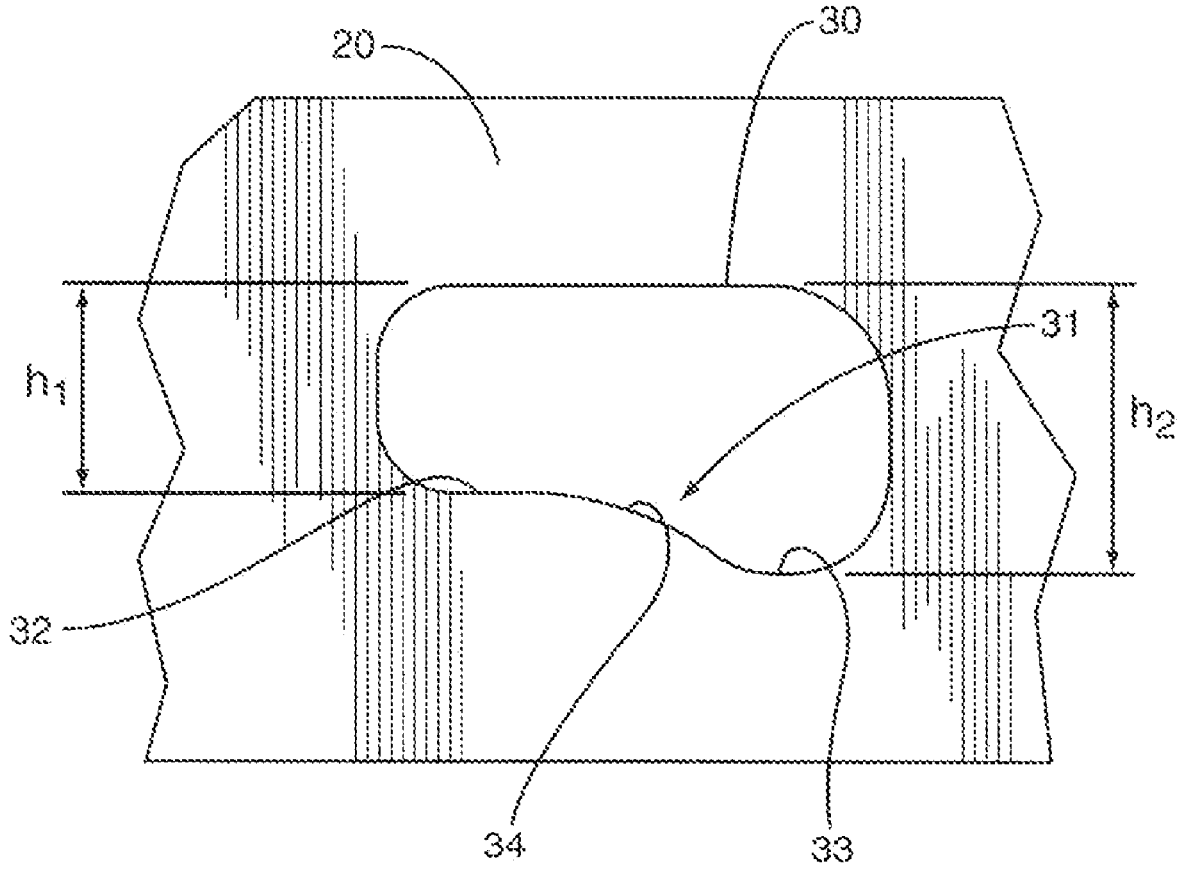
FIG. 5 is a side view of an opening in a lift plate according to one embodiment.

Openings 30 include a variable edge 31 as best illustrated in FIG. 5. The edge 31 is positioned towards the developer member 60 and includes a first section 32 and a second section 33. The first section 32 includes a first height h1 and the second section 33 includes a second height h2. The edge 31 within the first section 32 is positioned a farther distance from the developer member 60 than in the second section 33. The lengths of each of the sections 32, 33 may vary, as well as the distances of the edge 31 from the developer member 60. A transitional section 34 may be positioned between the sections 32, 33. The transitional section 34 may include a slope to facilitate moving the positioning member 61 between the sections 32, 33 as will be explained below.

One or more slots 39 may be positioned in the lift plate 20. The slots 39 include an elongated shape that extend along a longitudinal axis of the lift plate 20. Slots 39 are sized to receive studs 70 that extend outward from the body 112. The lift plate 20 is movable relative to the body 112 with the slots 39 moving about the studs 70.

A positioning member 61 is positioned within each of the openings 30, and is operatively connected to one of the developer members 60. The positioning member 61 is shaped and sized to move within the opening 30 and into each of the first section 32 and the second section 33. To provide for this movement, the positioning member 61 includes a height that is less than the heights h1, h2 of either sections 32, 33. In one embodiment, positioning member 61 includes a circular sectional shape.

A body 62 extends between and operatively connects the positioning member 61 and the developer member 60. In one embodiment, the body 62 includes an elongated shape to position the developer member 60 away from the lift plate 20. Body 62 may include a plate to receive an end of the developer member as illustrated in FIGS. 3 and 4. Body 62 may also include other shapes and sizes depending upon the context of use.

A hold down 40 is operatively connected to each of the positioning members 61. The hold down 40 functions to bias the positioning member downward in the opening 30 towards the first edge 31. FIG. 3 illustrates one embodiment of hold downs 40 each including an arm 41 pivotally attached to the lift plate 20 and in contact against the positioning member 61. A biasing member 42 is connected between the lift plate 20 and arm 41. The biasing member 42 applies a force to maintain the arm 41 against the positioning member 61, and the positioning member 61 biased towards the first edge 31. In this embodiment, the arm 41 contacts against an upper surface of the positioning member 61.

FIG. 4 includes another embodiment of the hold down 40 that includes an arm 41 pivotally connected to the lift plate 20. Arm 41 includes an opening 43 sized to receive the positioning member 61, which in this embodiment is a peg that extends outward from the body 62. A biasing member 42 positioned between the arm 41 and the lift plate 20 biases the arm 41 downward. This downward bias causes an end of the opening 43 to contact against and maintain the positioning member 61 towards the first edge 31 of the opening 30.

In one embodiment with multiple hold downs 40, each of the hold downs 40 is substantially the same. Another multiple hold down embodiment may include a variety of different hold downs 40.

Figure 6A:
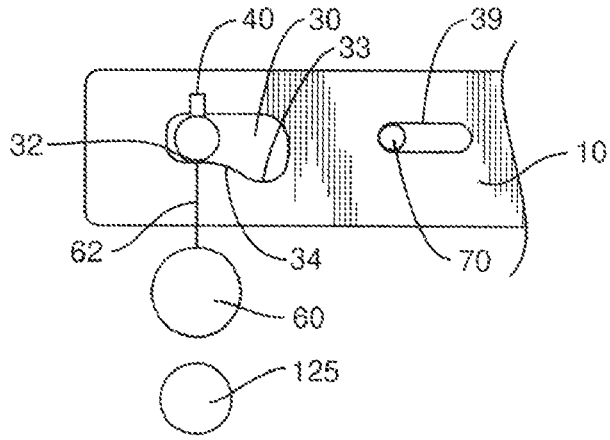
FIG. 6A is a schematic side view of a lift device in a first position according to one embodiment.
Figure 6B:
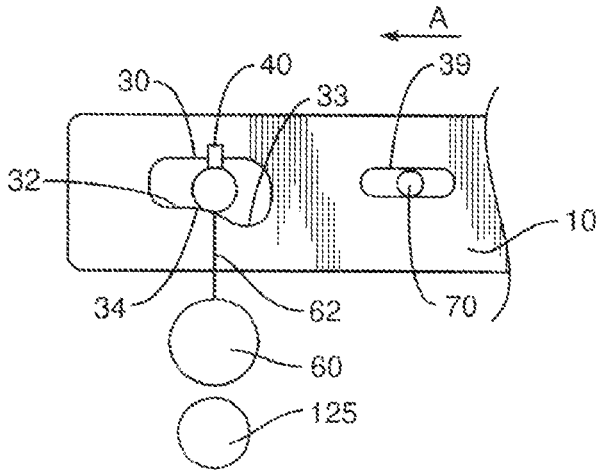
FIG. 6B is a schematic side view of a lift device moving from a first position towards a second position according to one embodiment.
Figure 6C:
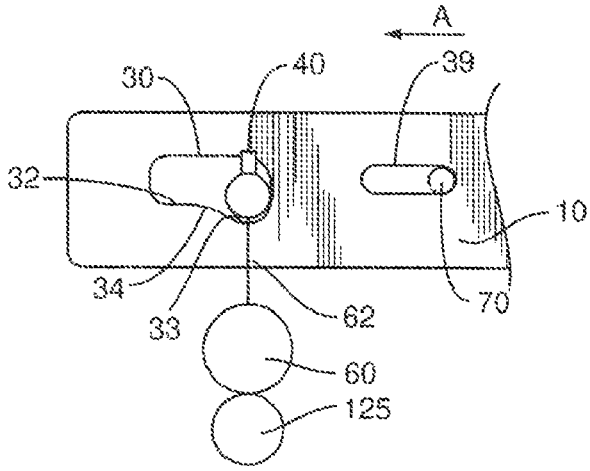
FIG. 6C is a schematic side view of a lift device in a second position according to one embodiment.

FIGS. 6A, 6B, and 6C illustrate one embodiment of the lift device 10 as it moves from a first position to a second position. For purposes of clarity, the lift device 10 controls the positioning of a single developer member 60. However, it is to be understood that the lift device 10 may control the position of various numbers of developer members 60.

FIG. 6A illustrates the lift device 10 in a first position. The lift plate 20 is located with the positioning member 61 in the first section 32 of the opening 30. The hold down 40 exerts a force such that the positioning member 61 contacts against the edge 31 of the first section 32. With the positioning member 61 against the edge 31 in the first section 32, the developer member 62 is spaced apart from the PC member 125. This first position may be used for shipping and storage of the image forming device 100 to prevent a set from occurring on the developer member 60.

FIG. 6B illustrates the lift plate 20 having been laterally moved a limited amount in the direction indicated by arrow A. The positioning member 61 has moved relative to the opening 30 and is in contact with the edge 31 in the transitional section 34. This placement causes the developer member 60 to still be spaced away from the PC member 125.

FIG. 6C illustrates the lift device 10 in the second position. The lift plate 20 has fully moved in the direction of arrow A. The extent of movement may be limited by the stud 70 contacting against an edge of the slot 39. The positioning member 61 is now within the second section 33 of the opening 30. The hold down 40 continues to place a downward force on the positioning member 61 that causes the developer member 60 to contact against the PC member 125. In this embodiment, the length of the body 62 causes the positioning member 61 to be spaced away from the edge 31. This ensures the edge 31 does not interfere with the ability of the developer member 61 to fully seat against the PC member 125. Further, the full force of the hold down 40 may be applied to ensure the developer member 60 is in contact with the PC member 125. This second position provides for image formation as toner may then be transferred from the developer member 60 to the PC member 125.

In the embodiment of FIG. 6C, the positioning member 61 is spaced away from the edge 31. In another embodiment, the positioning member 61 contacts the edge 31 when the lift device 10 is in the second position.

The lift device 10 may further including a biasing member 79 to bias the lift device 10 towards the second position. In one embodiment as illustrated in FIGS. 3 and 4, the biasing member 79 is positioned within an opening 71 in the lift plate 20. The biasing member 79 contacts against the lift plate 20 forcing it towards the second position. The force of the biasing member 79 may be overcome to move the lift device 10 to the first position. In one embodiment, the lift plate 20 extends outward from the body 112 of the image forming device 100. A holding member, such as a strap, may be attached to the lift plate 20 to maintain the lift device 10 in the first position for shipping and storage. The holding member may be removed as necessary to allow the biasing member 79 to move the lift plate 20 to the second position and allow the developer members 60 to contact against the PC members 125 for image formation.

In one embodiment, the lift plate 20 is attached to each of the developer members 60 within the image forming device 100. In another embodiment, the lift plate 20 is attached to a limited number of the developer members 60 within the device 100.

Terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to position a developer member relative to a photoconductive member within an image forming device comprising:

a lift plate positioned in proximity to the photoconductive member, the lift plate including an elongated shape that extends along a longitudinal axis;

an elongated opening positioned within the lift plate and extending in a direction along the longitudinal axis, the opening including a first section and a second section, the first section being positioned farther from the photoconductive member than the second section;

a positioning member positioned within the opening;

a body that extends between and operatively connects the positioning member and the developer member; and a hold down to bias the positioning member towards an edge of the opening;

the lift plate being longitudinally movable between a first position with the positioning member in the first section of the opening that positions the developer member away from the photoconductive member, and a second position with the positioning member in the second section that positions the developer member against the photoconductive member.

2. The device of claim 1, wherein the positioning member is in contact with the first section of the opening when the lift plate is in the first position, and the positioning member is spaced above the second section when the lift plate is in the second position.

3. The device of claim 1, wherein the opening further includes a ramped intermediate section between the first and second sections.

4. The device of claim 1, wherein a height of the opening is greater in the second section than in the first section.

5. The device of claim 1, wherein the lift plate further includes a slot sized to receive a stud, the slot being aligned along the longitudinal axis of the lift plate and including a shorter length than the opening.

6. The device of claim 1, further including a biasing member operatively connected to the lift plate to bias the lift plate towards the second position.

7. The device of claim 1, wherein the hold down is pivotally connected to the lift plate.

8. A device to position a plurality of developer members relative to a plurality of photoconductive members within an image forming device comprising:

an elongated lift-plate movably positioned within the image forming device;

a plurality of openings spaced apart along the lift plate, each of the openings including a first section and a second section with a common edge, the edge in the first section being positioned farther from a photoconductive member than in the second section;

a plurality of positioning members each positioned with one of the openings;

a plurality of bodies that each extend between and connect one of the positioning members and one of the developer members;

a plurality of hold downs each positioned to bias one of the plurality of positioning members towards the edge of one of the plurality of openings;

the lift plate movable within the image forming device between a first position with each of the positioning members in the first sections of the openings that positions each of the developer members away from each of the photoconductive members, and a second position within the image forming device with the positioning members in the second sections that positions each of the developer members against one of the photoconductive members.

9. The device of claim 8, wherein each of the plurality of openings includes a substantially identical shape.

10. The device of claim 8, wherein at least one of the plurality of openings includes the first section with a first height and the second section with a second greater height.

11. The device of claim 8, further comprising a second lift plate movably positioned within the image forming device, the lift plate positioned at a first side of the developer members and the second lift plate positioned at a second opposite side of the developer members.

12. The device of claim 8, wherein the positioning members are in contact with the edge in the first section of the openings when the lift plate is in the first position, and the positioning members are spaced above the edge in the second sections when the lift plate is in the second position.

13. The device of claim 8, wherein the lift plate further includes a plurality of slots each sized to receive a stud that extends from the image forming device, each of the slots being aligned along a longitudinal axis of the lift plate and including a shorter length than the openings.

14. The device of claim 8, further including a biasing member operatively connected to the lift plate to bias the lift plate towards the second position.

15. A method of positioning a developer member relative to a photoconductive member within an image forming device, the method comprising:

positioning a lift plate at a first lateral position within the image forming device and locating a positioning member within a first section of an opening in the lift plate;

biasing the positioning member towards an edge of the first section of the opening while the lift plate is at the first lateral position and causing the developer member that is operatively connected to the positioning member to be spaced away from the photoconductive member;

contacting the positioning member against the edge of the opening when the lift plate is at the first lateral position;

positioning the lift plate at a second lateral position within the image forming device and locating the positioning member within a second section of the opening in the lift plate; and biasing the positioning member towards the photoconductive member when the positioning member is in the second section of the opening in the lift plate and causing the developer member that is operatively connected to the positioning member to contact the photoconductive member.

16. The method of claim 15, further comprising biasing the lift plate towards the second lateral position and causing the developer member to remain in contact with the photoconductive member.

17. The method of claim 15, further comprising contacting the positioning member against the edge of the opening when the lift plate is at the second lateral position.

18. The method of claim 15, further comprising spacing the positioning member away from an edge of the second section when the lift plate is at the second lateral position.

19. The method of claim 15, further comprising moving the developer member in a vertical position within the image forming device.

* * * * *